US007837285B2

(12) United States Patent
Couwenhoven et al.

(10) Patent No.: US 7,837,285 B2
(45) Date of Patent: Nov. 23, 2010

(54) INKJET PRINTING USING PROTECTIVE INK

(75) Inventors: Douglas W. Couwenhoven, Fairport, NY (US); Steven A. Billow, Victor, NY (US); Richard C. Reem, Hilton, NY (US)

(73) Assignee: Eastman Kodak Company, Rochester, NY (US)

( * ) Notice: Subject to any disclaimer, the term of this patent is extended or adjusted under 35 U.S.C. 154(b) by 921 days.

(21) Appl. No.: 11/687,119

(22) Filed: Mar. 16, 2007

(65) Prior Publication Data

US 2008/0225081 A1 Sep. 18, 2008

(51) Int. Cl.
*B41J 29/38* (2006.01)

(52) U.S. Cl. ..... 347/6; 347/14; 347/43; 347/100

(58) Field of Classification Search ..... None
See application file for complete search history.

(56) References Cited

U.S. PATENT DOCUMENTS 6,428,157 B1 8/2002 Wen
6,435,657 B1 8/2002 Couwenhoven et al.
6,561,644 B2 5/2003 Romano, Jr. et al.
6,585,363 B1 7/2003 Tanaka et al.
6,857,733 B2 2/2005 Issler
6,863,392 B2 3/2005 Shimomura et al.
6,877,850 B2 4/2005 Ishimoto et al.
6,953,244 B2 10/2005 Chen et al.
2005/0185004 A1 * 8/2005 Couwenhoven et al. ..... 347/6
2005/0185008 A1 8/2005 Couwenhoven et al.
2006/0203061 A1 * 9/2006 Ichinose et al. ..... 347/100

* cited by examiner

*Primary Examiner*—Stephen D Meier
*Assistant Examiner*—Alexander C Witkowski
(74) *Attorney, Agent, or Firm*—Raymond L. Owens

(57) ABSTRACT

A method for modifying an input digital image having one or more color channels corresponding to one or more color inks and a protective ink channel corresponding to a substantially clear protective ink, each channel having an (x,y) array of pixel values, to form a modified digital image including computing a first value responsive to corresponding pixel values of the one or more color channels; computing a second value responsive to the corresponding pixel value of the protective ink channel; and modifying the corresponding pixel value of the protective ink channel responsive to the first and second values.

11 Claims, 10 Drawing Sheets

| C | M | Y | K | P | P' |
|---|---|---|---|---|---|
| 0 | 0 | 0 | 0 | 0 | 0 |
| 0 | 0 | 0 | 0 | 1 | 1 |
| 0 | 0 | 0 | 1 | 0 | 0 |
| 0 | 0 | 0 | 1 | 1 | 1 |
| 0 | 0 | 1 | 0 | 0 | 0 |
| 0 | 0 | 1 | 0 | 1 | 1 |
| 0 | 0 | 1 | 1 | 0 | 0 |
| 0 | 0 | 1 | 1 | 1 | 1 |
| 0 | 1 | 0 | 0 | 0 | 0 |
| 0 | 1 | 0 | 0 | 1 | 1 |
| 0 | 1 | 0 | 1 | 0 | 0 |
| 0 | 1 | 0 | 1 | 1 | 1 |
| 0 | 1 | 1 | 0 | 0 | 0 |
| 0 | 1 | 1 | 0 | 1 | 1 |
| 0 | 1 | 1 | 1 | 0 | 0 |
| 0 | 1 | 1 | 1 | 1 | 1 |
| 1 | 0 | 0 | 0 | 0 | 0 |
| 1 | 0 | 0 | 0 | 1 | 1 |
| 1 | 0 | 0 | 1 | 0 | 0 |
| 1 | 0 | 0 | 1 | 1 | 1 |
| 1 | 0 | 1 | 0 | 0 | 0 |
| 1 | 0 | 1 | 0 | 1 | 1 |
| 1 | 0 | 1 | 1 | 0 | 0 |
| 1 | 0 | 1 | 1 | 1 | 1 |
| 1 | 1 | 0 | 0 | 0 | 0 |
| 1 | 1 | 0 | 0 | 1 | 1 |
| 1 | 1 | 0 | 1 | 0 | 0 |
| 1 | 1 | 0 | 1 | 1 | 1 |
| 1 | 1 | 1 | 0 | 0 | 0 |
| 1 | 1 | 1 | 0 | 1 | 1 |
| 1 | 1 | 1 | 1 | 0 | 0 |
| 1 | 1 | 1 | 1 | 1 | 1 |

100 120 110 105

FIG. 4

135

| C | M | Y | K | Ri |
|---|---|---|---|---|
| 0 | 0 | 0 | 0 | 0 |
| 0 | 0 | 0 | 1 | 1 |
| 0 | 0 | 1 | 0 | 2 |
| 0 | 0 | 1 | 1 | 3 |
| 0 | 1 | 0 | 0 | 4 |
| 0 | 1 | 0 | 1 | 5 |
| 0 | 1 | 1 | 0 | 6 |
| 0 | 1 | 1 | 1 | 7 |
| 1 | 0 | 0 | 0 | 8 |
| 1 | 0 | 0 | 1 | 9 |
| 1 | 0 | 1 | 0 | 10 |
| 1 | 0 | 1 | 1 | 11 |
| 1 | 1 | 0 | 0 | 12 |
| 1 | 1 | 0 | 1 | 13 |
| 1 | 1 | 1 | 0 | 14 |
| 1 | 1 | 1 | 1 | 15 |

FIG. 6

INKJET PRINTING USING PROTECTIVE INK

FIELD OF THE INVENTION

This invention pertains to the field of inkjet printing systems, and more particularly to a method for reducing ink bleed artifacts.

BACKGROUND OF THE INVENTION

Ink jet printers have become a very common way for printing images from a computer. Ink jet printers work by spraying small drops of colorants (ink) onto a receiver to form an image. Typically, ink jet printers use four or more different colors of colorants to produce colored images. Most commonly cyan (C), magenta (M), yellow (Y), and black (K) colorants are used. Different types of ink having different chemical compositions are known in the art. Two common types of ink are dye-based inks and pigment-based inks. Each of these ink types are known to have certain advantages and disadvantages. Dye-based inks are known to produce a wide range of colors, but have poor image durability characteristics, and are subject to fading or damage over time with exposure to light or moisture. The term "gloss" refers to light, which is reflected off of the front surface of the print, and appears when an image is viewed in a near specular orientation. Pigmented inks are known to provide good image durability characteristics, but can suffer from gloss artifacts (any unexpected appearance of gloss) that result in a perceived image quality loss. These gloss artifacts include "differential gloss", which is an abrupt undesirable change in gloss appearing between two adjacent regions in an image; "chromatic gloss", which is an undesirable change in the color of the gloss that appears when an image is viewed in a near specular orientation; and "haze", which refers to a cloudy or smoky appearance to an image resulting from light scattering off of the surface of the print.

Several methods to address the undesirable gloss artifacts described above are known in the art. One technique known in the art is to laminate the print, but this is typically too time-consuming and costly. Another technique is to apply an additional, substantially clear ink to the entire image during or shortly after the printing process. For example, see U.S. Pat. Nos. 6,428,157, and 6,561,644. The application of a full layer of clear ink on top of an area printed with pigmented inks is likely unnecessary to achieve the desired mitigation of gloss artifacts, and is wasteful of ink. Also, indiscriminate application of clear ink leads to a dramatic increase in the total amount of fluid deposited on the page, which is known to cause other negative image quality artifacts. See for example U.S. Pat. No. 6,435,657.

Other techniques known in the art attempt to reduce differential gloss by applying a clear ink in unprinted areas. See for example U.S. Pat. Nos. 6,857,733, 6,953,244, and 6,863,392.

In U.S. patent application Ser. No. 6,877,850, a method of applying clear ink based on the total duty of the colored ink is disclosed. Similarly, U.S. Pat. No. 6,585,363 to Tanaka, et al., discloses a method of applying a clear ink in which the CMYK ink amounts are summed to generate a map of printed pixels. The map is then "thinned" using a masking process to determine which locations will receive the clear ink.

The above mentioned references teach the use of a clear ink for improving some of the aforementioned gloss artifacts, but do not teach methods of controlling the laydown of the clear ink in response to the mixture of colored ink that will be printed. For example, the gloss properties of the different colored inks can be different, thereby requiring different amounts of clear ink to be applied to reduce differential gloss based on the mixture of the colored inks that are printed. Thus, there is a need for a method of computing a clear ink amount to be applied to an image to provide for improved image quality by minimizing gloss related artifacts, while minimizing the total amount of fluid deposited on the page by not printing clear ink where it is unnecessary.

SUMMARY OF THE INVENTION

It is an object of the present invention to provide a method for modifying an input digital image having one or more color channels corresponding to one or more color inks and a protective ink channel corresponding to a substantially clear protective ink, each channel having an (x,y) array of pixel values, to form a modified digital image including computing a first value responsive to corresponding pixel values of the one or more color channels; computing a second value responsive to the corresponding pixel value of the protective ink channel; and modifying the corresponding pixel value of the protective ink channel responsive to the first and second values.

ADVANTAGES

This invention has the advantage in that it provides for improved image quality by reducing gloss related artifacts. Another advantage is that the invention provides for controlling the protective ink amount in response to the colored ink amounts.

BRIEF DESCRIPTION OF THE DRAWINGS

FIG. 4 is a data table showing the multidimensional look-up table 90 of FIG. 3;

FIG. 6 is a data table showing the row index generator 130 of FIG. 5;

DETAILED DESCRIPTION OF THE INVENTION

This invention describes a method for computing a protective ink amount to be printed in addition to a plurality of colored ink amounts to provide for improved image quality as set forth in the objects described above. The protective ink typically provides for improved image quality or durability properties, but has no colorant and is substantially clear. In this invention we use the term "protective ink" generically to mean any substantially clear ink, even if the clear ink has no protective function. The invention is presented hereinafter in the context of an inkjet printer using pigmented inks. However, it should be recognized that this method is applicable to other printing technologies as well.

The gloss artifacts described above arise from the physical properties of the inks interacting with the receiver media, or from certain combinations of the inks interacting in an undesirable way when printed at the same pixel on the page. This is especially true for pigmented inks. Conversely, the gloss artifacts can be substantially improved by forcing certain desirable combinations of ink to be printed on the page or preventing certain undesirable combinations from being printed. For example, it can be that when a cyan ink drop is printed at a given pixel without any other inks, an undesirable chromatic gloss effect is observed. However, the chromatic gloss can be substantially reduced by forcing a drop of protective ink to also be printed when only a cyan ink drop is present. This level of control is provided by the present invention, as will be discussed below.

An input image is composed of a two dimensional (x,y) array of individual picture elements, or pixels, and can be represented as a function of two spatial coordinates, (x and y), and a color channel coordinate, c. The location of the pixel within the image is represented by the spatial coordinates, and each pixel has a set of corresponding pixel values containing the code value at the pixel location from each of the color channels. Each unique combination of the spatial coordinates defines the location of a pixel within the image, and each pixel possesses a set of input code values representing input colorant amounts for a number of different inks indexed by the color channel coordinate, c. Each input code value representing the amount of ink in a color channel is generally represented by integer numbers on the range {0,255}. A typical set of inks for an inkjet printer includes cyan (C), magenta (M), yellow (Y), black (K) inks, and protective (P) inks, hereinafter referred to as CMYKP inks. The protective ink (P) is simply treated as an additional colorant channel. It should be noted that the present invention will apply to any number of colored inks of any color used in combination with a substantially clear protective ink.

Figure 1:
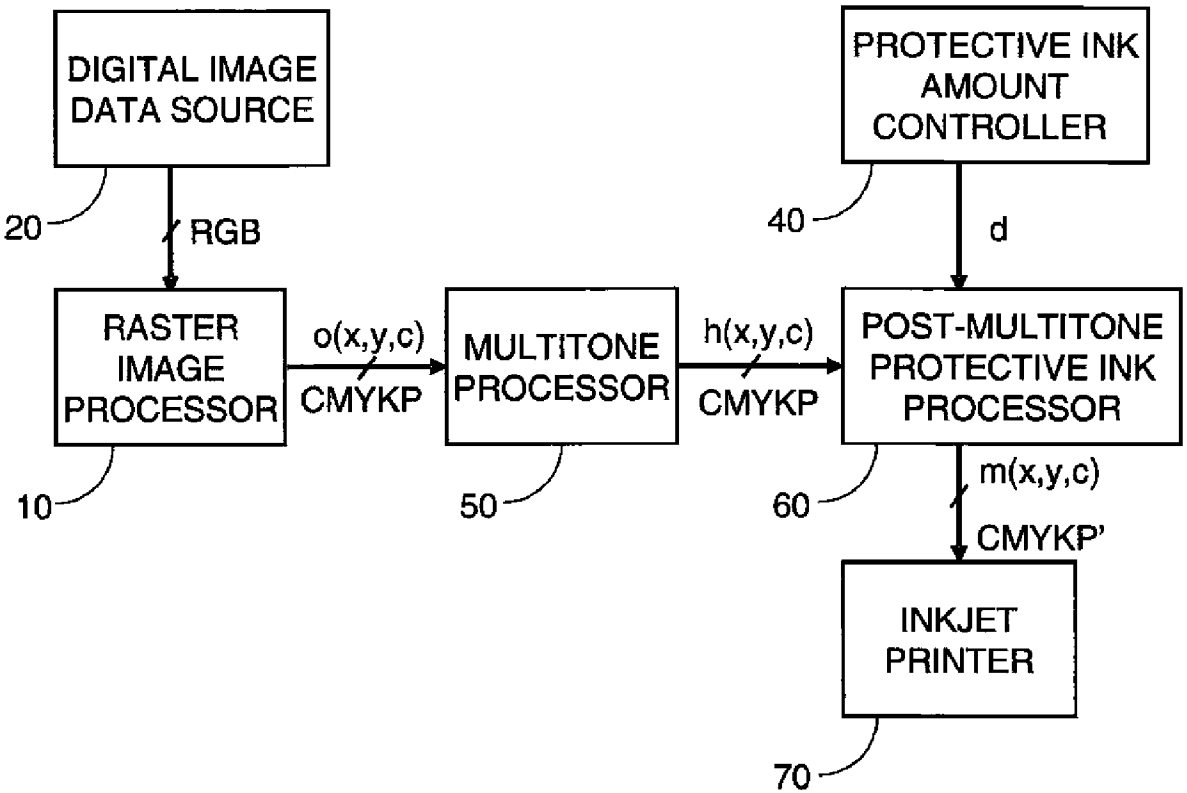
FIG. 1 is a flow diagram showing the image processing chain for a inkjet printer in accordance with the present invention.

Referring to FIG. 1, a generic image processing algorithm chain is shown for an inkjet printer in which a raster image processor 10 receives digital image data in the form of an input image from a digital image data source 20, which can be a host computer, network, computer memory, or other digital image storage device. The raster image processor 10 applies imaging algorithms to produce a processed digital image signal having output code values o(x,y,c), where x,y are the spatial coordinates of the pixel location, and c is the color channel coordinate. In one embodiment of the present invention, c has values 0, 1, 2, 3, or 4 corresponding to C, M, Y, K, P color channels, respectively. The types of imaging algorithms applied in the raster image processor 10 typically include sharpening (sometimes called "unsharp masking" or "edge enhancement"), color conversion (converts from the source image color space, typically RGB, to the CMYKP color space of the printer), resizing (or spatial interpolation), and others. The imaging algorithms that are applied in the raster image processor 10 can vary depending on the application, and are not fundamental to the present invention.

Following the raster image processor 10 of FIG. 1 is a multitone processor 50, which receives the output code value o(x,y,c) and produces a multitoned image signal h(x,y,c), having multitoned pixel values. The multitone processor 50 performs the function of reducing the number of bits used to represent each image pixel to match the number of printing levels available in the printer. Typically, the output code value o(x,y,c) will have 8 to 12 bits per pixel (per color), and the multitone processor 50 generally reduces this to 1 to 3 bits (corresponding to 2 to 8 printing levels) per pixel (per color) depending on the number of available printing levels. The multitone processor 50 can use a variety of different methods known to those skilled in the art to perform the multitoning. Such methods typically include error diffusion, clustered-dot dithering, or stochastic (blue noise) dithering. The particular multitoning method used in the multitone processor 50 is not fundamental to the present invention. Following the multitone processor 50 is a post-multitone protective ink processor 60, which receives control parameters d from the protective ink amount controller 40, and processes the multitoned image signal h(x,y,c) to produce a modified multitoned signal m(x,y,c), which is sent to an inkjet printer 70 that deposits ink on the page accordingly to produce the desired image. The implementation of the post-multitone protective ink processor 60 is the main subject of the present invention, and will be described hereinafter.

It is important for the following discussion to understand the difference between the protective ink amount that is described by the output code values o(x,y,c) of the raster image processor 10 of FIG. 1, the protective ink amount described by the multitoned image signal h(x,y,c), and the modified protective ink amount described by the modified multitoned image signal m(x,y,c). Recall that each of these signals has a color coordinate, c, and that c=4 corresponds to the protective ink in this example. The protective ink amount described by the output code value o(x,y,4) is a continuous-tone pixel value generally on the range 0-255, and represents the desired amount of protective ink to be printed, as controlled by the color conversion process in the raster image processor 10. However, the raster image processor 10 cannot control exactly which inks get printed at a given pixel, because the output code values o(x,y,c) do not directly correspond to printing drops, and a multitone process is required to reduce the number of levels in the output code values o(x,y,c) down to match the number of available printing levels. Thus, the color conversion process in the raster image processor 10, which creates the continuous tone ink amounts o(x,y,c) cannot avoid the aforementioned undesirable ink combinations (or force desired ink combinations) due to the fact that the output code values o(x,y,c) have not yet been multitoned. Thus, the raster image processor 10 is unable to avoid the undesirable gloss artifacts as described above.

The output code values o(x,y,c) are halftoned by the multitone processor 50 to produce the multitoned image signal h(x,y,c). While the multitone processor 50 will preserve the desired amount of each ink in a local area, it can produce undesirable combinations of inks at a given pixel. This occurs because the multitone processor 50 does not have information about which combinations of inks are undesirable and will result in gloss artifacts, or which combinations of inks are desirable to reduce gloss artifacts. Thus, the multitone processor 50 is also incapable of avoiding undesirable gloss artifacts as described above. The post-multitone protective ink processor 60 serves the function of eliminating the undesirable combinations of inks (or creating desirable combinations of inks) by modifying the protective ink amount according to the control parameters d supplied by the protective ink amount controller 40. The control parameters d contain information on which combinations of inks are undesirable and produce gloss artifacts, and which combinations of inks are desirable to reduce gloss artifacts.

Figure 2:
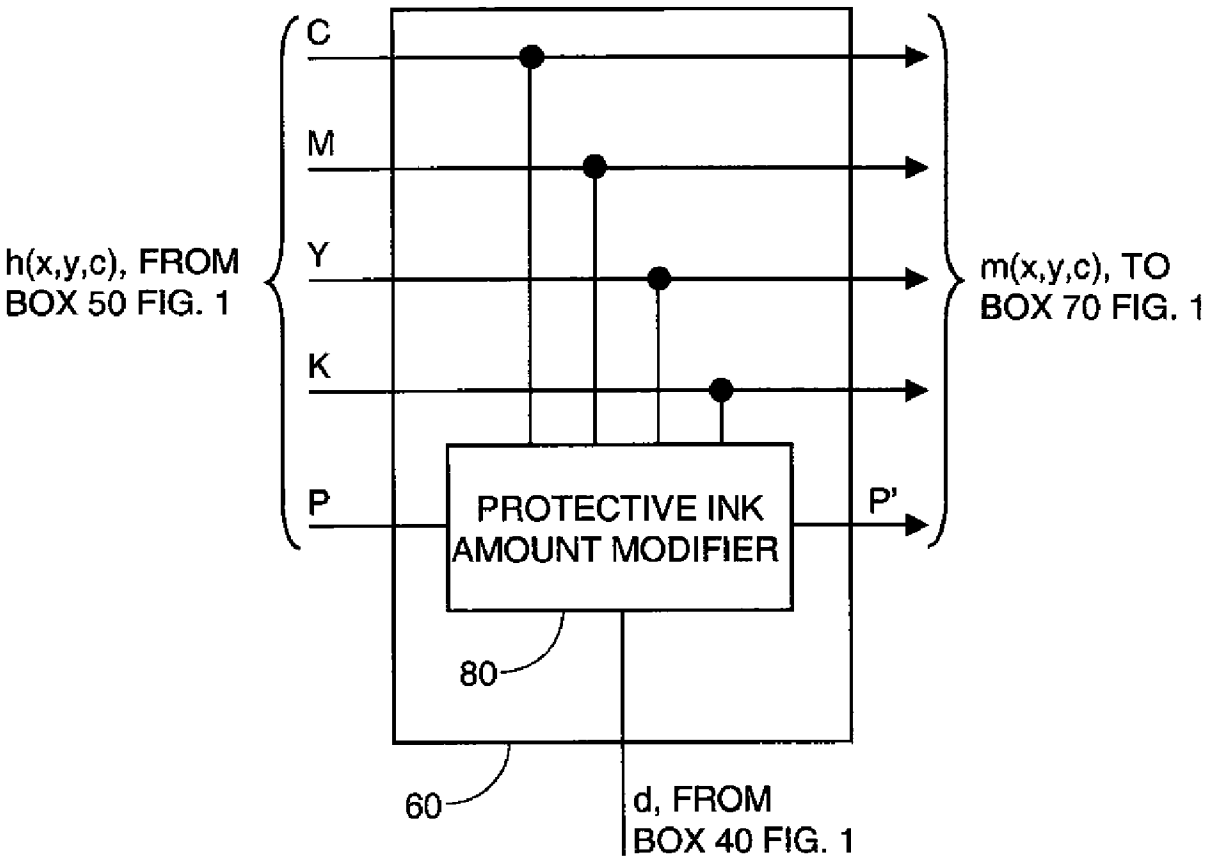
FIG. 2 is a flow diagram showing the details of the post-multitone protective ink processor 60 of FIG. 1.
Figure 3:
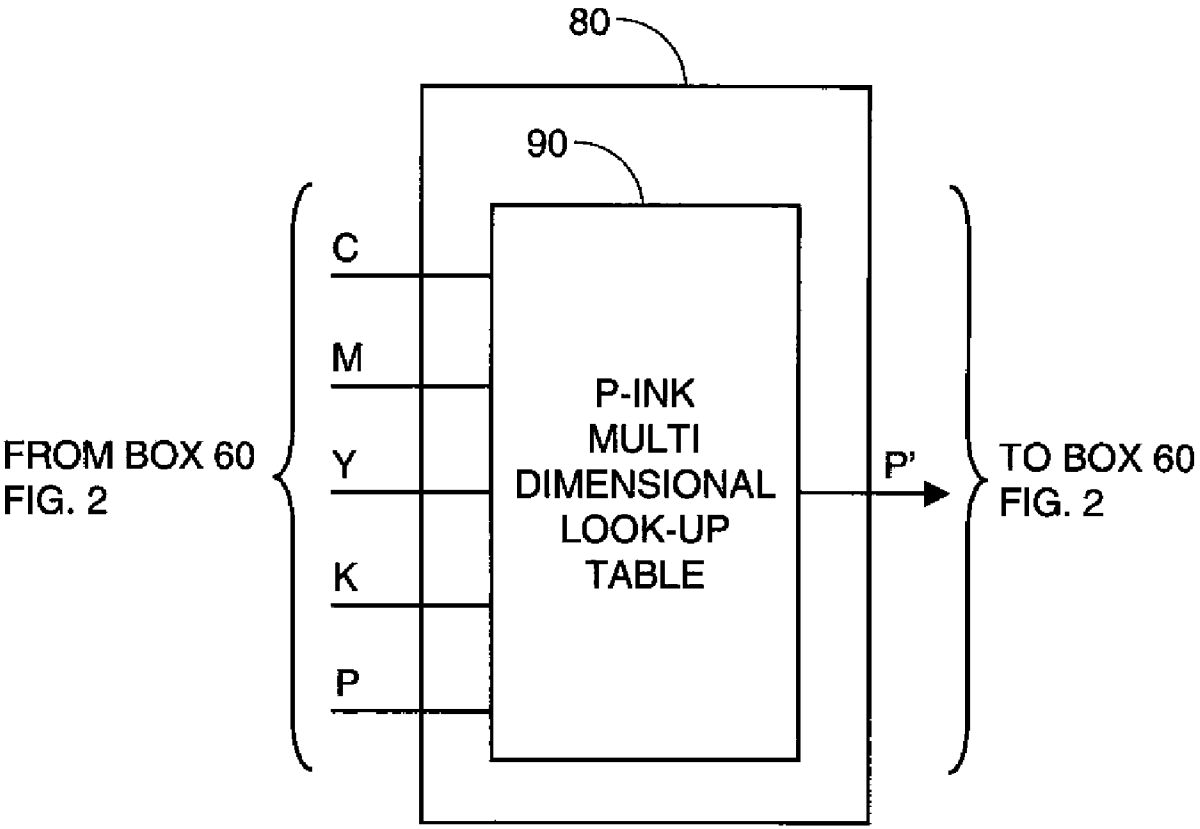
FIG. 3 is a flow diagram showing the details of the protective ink amount modifier 80 of FIG. 2 according to one embodiment of the present invention.

Turning now to FIG. 2, the details of the post-multitone protective ink processor 60 will now be described. The multitoned image signal h(x,y,c) is composed of multitoned image signals for each color channel, which are shown for clarity as separate C, M, Y, K, and P signals coming into the left side of the post-multitone protective ink processor 60 of FIG. 2. The CMYKP multitoned image signals are received by a protective ink amount modifier 80, which produces a modified protective ink amount P', in accordance with the control parameters d. The modified protective ink amount P' is part of the modified multitoned image signal m(x,y,c), which is sent to the inkjet printer to be printed. In a preferred embodiment of the present invention, the CMYK multitoned image signals are not modified by the post-multitone protective ink processor 60, and are simply passed through. The protective ink amount modifier 80 selectively modifies the protective ink amount according to the control parameters d to reduce the aforementioned undesirable gloss artifacts. According to one embodiment of the present invention, the protective ink amount modifier 80 employs a P-ink multidimensional look-up table 90 as shown in FIG. 3. In this arrangement, the CMYKP multitoned code values are used as inputs to a multidimensional look-up table which stores the modified protective ink amount P'. One skilled in the art will recognize that the multidimensional look-up table approach provides for a large degree of flexibility in controlling the protective ink amount, but suffers from the computational complexity of performing a multidimensional interpolation process. However, since the CMYKP multitoned code values that are the input dimensions of the table typically have a small number of possible levels (generally 2 to 8 levels per color), then the multidimensional look-up table can be replaced with a 1D look-up table, where the index value is computed by simply shifting and adding the multitoned code values for the individual color channels. Such techniques will be known to one skilled in the art, and are not fundamental to the invention. An example of a multidimensional look-up table for a binary inkjet printer having two possible printing levels (0 or 1 corresponding to 0 or 1 drops of ink) is shown in FIG. 4 as multidimensional look-up table 105, where the C, M, Y, K, and P columns are the input dimensions of the table, and the P' column stores the modified protective ink amount, which is the output of the table. Notice in this table as indicated by table cell 100 that the P' value is set to 0 when Y and P are set to 1. This indicates that for a particular set of Y and P inks, an undesirable gloss artifact occurs when these two inks are printed together at the same pixel with no other inks present. To prevent the artifact, the P' value is set to 0, effectively "erasing" the P ink from that pixel. Also notice that it is possible using the method of the present invention to have two pixels have the same total amount of colored ink, but receive different amounts of protective ink, as indicated by table cells 110 and 120. This arrangement is not possible using prior art techniques.

Figure 5:
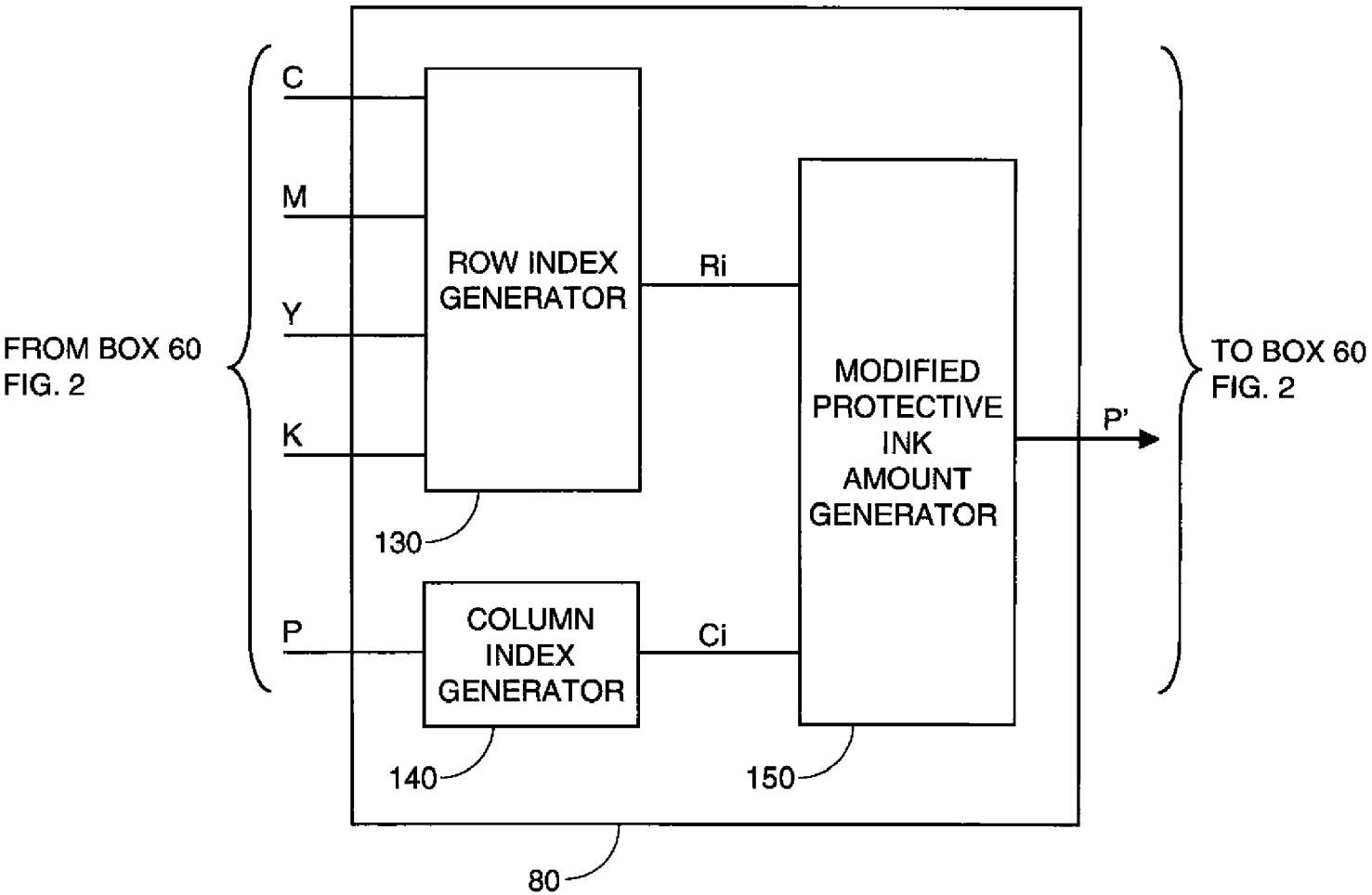
FIG. 5 is a flow diagram showing the details of the protective ink amount modifier 80 of FIG. 2 according to a preferred embodiment of the present invention.

Turning now to FIG. 5, an alternate implementation of the protective ink amount modifier 80 of FIG. 2 is shown according to a preferred embodiment of the present invention. In this arrangement, the CMYK multitoned image signals are received by a row index generator 130, which computes a row index Ri according to the following:

$$Ri=K+nY+n^2M+n^3C$$

where C, M, Y, and K are the multitoned code values and n is the number of printing levels available. For example, in a binary inkjet printer that can print either 0 or 1 drops of each ink at each pixel, C, M, Y, and K will each be 0 or 1 corresponding to the desired number of drops of each ink, and n will be 2, which is the number of available printing levels (0 or 1). In a multilevel inkjet printer that can print 0, 1, or 2 drops of each ink at each pixel, the values of C, M, Y, and K will be 0, 1, or 2, and n will be 3. Those skilled in the art will recognize that the equation above can be implemented with bit shift operations (also called "shifts") and addition operations (also called "adds") according to the following:

$$Ri=K+(Y<<b)+(M<<2b)+(C<<3b)$$

where the "<<" operator indicates a bitwise left shift, similar to the bitwise left shift operator in the C programming language, and b is the number of bits used to represent each code value. It should be noted that order or sequence in which the CMYK multitoned code values are shifted and added (i.e., whether C is the least significant or most significant bit values) is not important, as long as it is consistent with the way the row index Ri is interpreted in the subsequent processing. A data table 135 showing the mapping between the CMYK multitoned code values and the row index Ri for a binary inkjet printer system is shown in FIG. 6.

Figure 7:
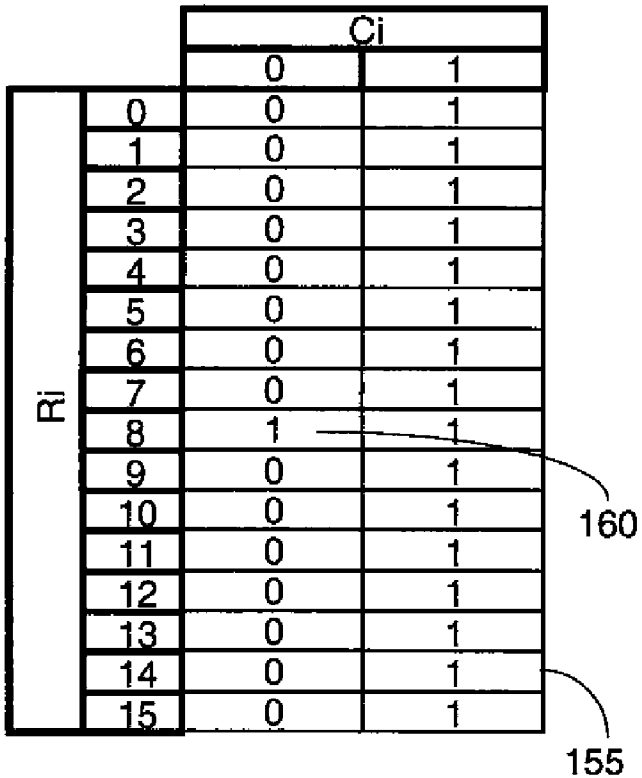
FIG. 7 is a data table showing the modified protective ink amount generator 150 of FIG. 5 used to reduce chromatic gloss artifacts.

Referring again to FIG. 5, the P multitoned image code value is received by a column index generator 140, which produces a column index Ci. In a preferred embodiment, the column index Ci is simply set equal to the P multitoned image code value. The row index Ri and column index Ci are then used by a modified protective ink amount generator 150 to produce a modified protective ink amount P'. In a preferred embodiment, the modified protective ink amount generator 150 is implemented using a 2D look-up table indexed by the row index Ri in one dimension, and the column index Ci in the other dimension. The 2D look-up table stores the value of the modified protective ink amount, P'. The 2D look-up table is populated with data provided by the control parameters d supplied by the protective ink amount controller 40 of FIG. 1. An example of a 2D look-up table is shown in FIG. 7 as 2-D look-up table 155. In this table, the protective ink amount is left unchanged for all combinations of CMYK ink, except for the case when C ink is the only colored ink present. According to the data table shown in FIG. 6, the value of the row index Ri=8 corresponds to 1 drop of C ink and 0 drops of the other colored inks (M,Y,K). Examining the Ri=8 row of the 2D look-up table in FIG. 7 shows that if Ci=0, indicating that no protective ink is currently printed with the C ink drop, then the modified protective ink amount will be 1, indicating that 1 drop of protective ink should be printed, as indicated by table cell 160 of the 2D look-up table. This, in effect, forces 1 drop of protective ink to additionally be printed whenever 1 drop of C ink would normally be printed alone. For a particular set of inks, this arrangement results in a dramatic improvement in chromatic gloss artifacts, thereby providing for improved image quality.

As will be obvious to one skilled in the art, different ink chemistries will result in different gloss artifacts. For example, it can turn out for a particular set of inks that the C ink printed alone does not produce an undesirable chromatic gloss, and therefore modified protective ink value stored in table cell 160 of the 2D look-up table of FIG. 7 could be left as a 0, indicating no modification of the protective ink amount is necessary. As such, the construction of the 2D look-up table of FIG. 7 must be done with reference to a particular set of inks, with the gloss artifacts for the inks being described by the control parameters d supplied by the protective ink amount controller 40 of FIG. 1.

Figure 8:
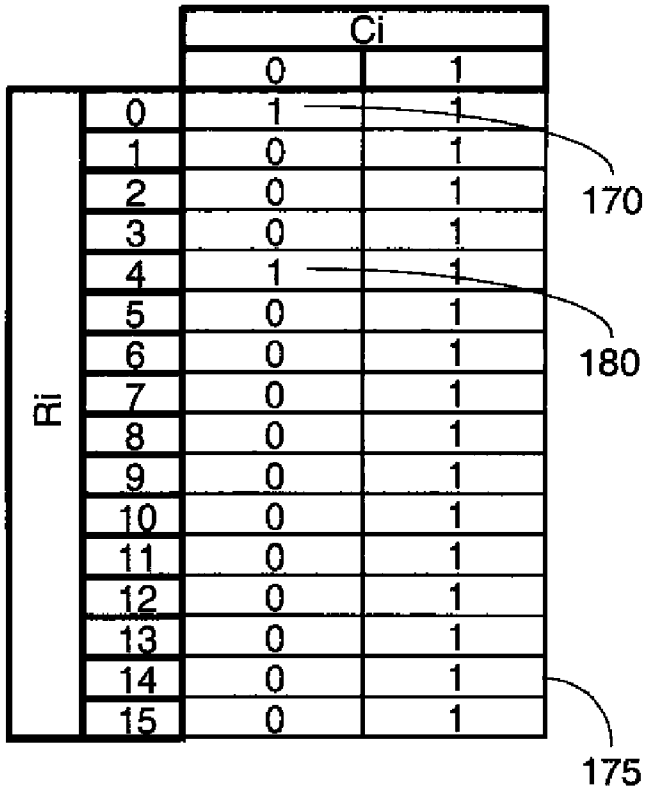
FIG. 8 is a data table showing the modified protective ink amount generator 150 of FIG. 5 used to reduce differential gloss artifacts.

Now, several embodiments of the present invention as applied to control different gloss artifacts will be described. Consider a set of inks and a receiver media where the gloss of the unprinted receiver media is relatively low and the gloss of M ink printed alone is relatively high. Without correction, this can lead to a gloss artifact called "differential gloss", wherein adjacent printed regions have different gloss, giving the printed image an unnatural appearance. Assume for this example that the gloss of the protective ink is somewhere between the low gloss of the media and the high gloss of the M ink. Referring to FIG. 8, a 2D look-up table 175 is shown according to the present invention that can correct for the differential gloss artifact by forcing a drop of protective ink to be printed when otherwise only unprinted media would occur (as indicated by table cell 170), and forcing a drop of protective ink to also be printed when otherwise only a drop of M ink would occur (as indicated by table cell 180). This would result in an increase in gloss of the white areas of the page, and a decrease in gloss in the magenta areas of the page, thereby reducing the undesirable differential gloss artifact. It is interesting to note that the present invention could equally be applied to increase the differential gloss effect, if such an effect was desired, by reversing the application of the protective ink as described above.

Figure 9:
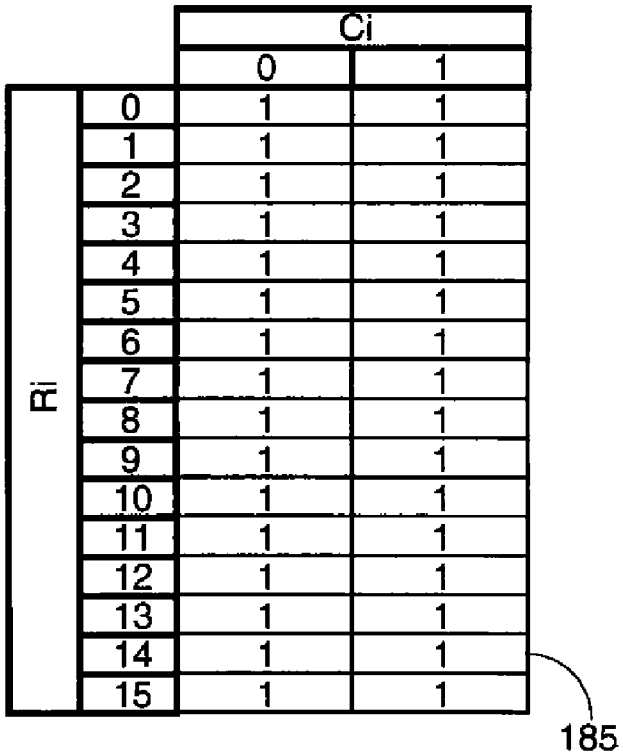
FIG. 9 is a data table showing the modified protective ink amount generator 150 of FIG. 5 used to reduce haze artifacts.

Another embodiment of the present invention can be used to improve "haze", which refers to a cloudy or smoky appearance to an image resulting from light scattering off of the surface of the print. Assume for a particular set of inks that the addition of protective ink to all printed colors results in a more uniform surface to the print, which causes less scattering of light and lower haze. Such an improvement could be achieved by utilizing the 2D look-up table 185 shown in FIG. 9, wherein protective ink is applied to all printed colors as indicated by the value of 1 in all entries of the Ci=0 column of the table.

Figure 10:
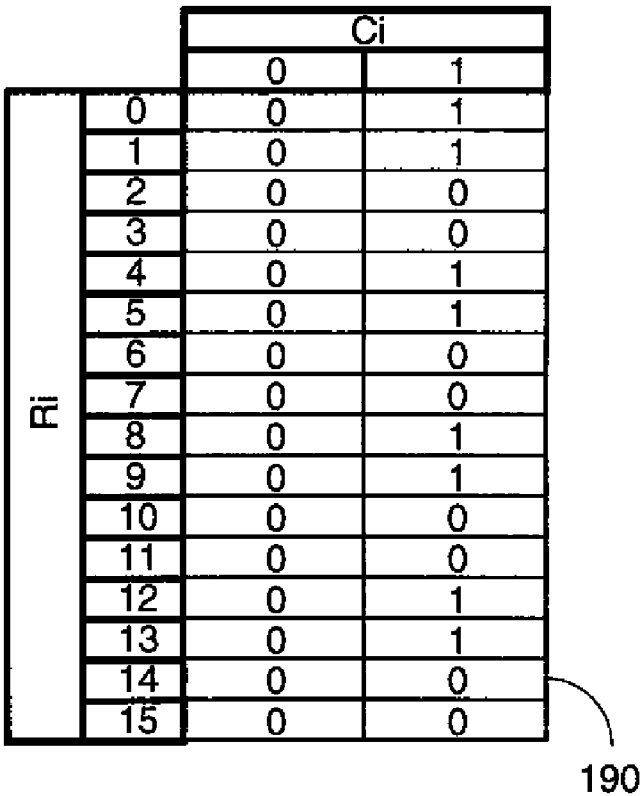
FIG. 10 is a data table showing the modified protective ink amount generator 150 of FIG. 5 used to reduce the total ink usage.

Another embodiment of the present invention can be used to reduce ink usage by the efficient use of the protective ink. It has been found for a particular ink set that the addition of protective ink to certain colors provides for improvement in gloss artifacts, but that the gloss artifacts are largely absent for other colors. In these cases, the protective ink is not required to reduce gloss artifacts, and a savings of ink can be realized by not printing the protective ink where it is not needed. As an example, assume that the Y ink does not produce gloss artifacts, and when Y is printed with other ink colors it serves to reduce the gloss artifacts much the same way the protective ink does. Therefore, any pixel receiving Y ink does not require P ink, but P ink is still required for other colors to reduce gloss artifacts. A 2D look-up table 190 designed to implement this arrangement is shown in FIG. 10, where the P ink has been "erased" for pixels containing Y ink already (Ri=2, 3, 6, 7, 10, 11, 14, 15).

The invention has been described in detail with particular reference to certain preferred embodiments thereof, but it will be understood that variations and modifications can be effected within the spirit and scope of the invention.

PARTS LIST

10 raster image processor
20 digital image data source
40 protective ink amount controller
50 multitone processor
60 post-multitone protective ink processor
70 inkjet printer
80 protective ink amount modifier
90 multidimensional look-up table
100 table cell
105 multidimensional look-up table
110 table cell
120 table cell
130 row index generator
135 data table
140 column index generator
150 modified protective ink amount generator
155 2-D look-up table
160 table cell
170 table cell
175 2-D look-up table
180 table cell
185 2-D look-up table
190 2-D look-up table

The invention claimed is:

1. A method for modifying an input digital image having one or more color channels corresponding to one or more color inks and a protective ink channel corresponding to a substantially clear protective ink, each channel having an (x,y) array of pixel values, to form a modified digital image comprising:

a) computing a first value responsive to corresponding pixel values of the one or more color channels;

b) computing a second value responsive to the corresponding pixel value of the protective ink channel; and c) modifying the corresponding pixel value of the protective ink channel responsive to the first and second values.

2. The method of claim 1 wherein the pixel values are multitoned pixel values having N discrete levels, where N is an integer greater than or equal to 2.

3. The method of claim 1 wherein the protective ink channel pixel values are modified to reduce chromatic gloss artifacts.

4. The method of claim 1 wherein the protective ink channel pixel values are modified to reduce differential gloss artifacts.

5. The method of claim 1 wherein the protective ink channel pixel values are modified to increase differential gloss artifacts.

6. The method of claim 1 wherein the protective ink channel pixel values are modified to reduce haze artifacts.

7. The method of claim 1 wherein the protective ink channel pixel values are modified to reduce overall ink usage while substantially preserving image quality.

8. The method of claim 1 wherein the protective ink channel pixel values are modified to reduce the amount of protective ink that is applied to at least a first color while preserving the amount of protective ink that is applied to at least a second color.

9. The method of claim 1 wherein step c includes employing a multidimensional look-up table indexed by the pixel values of the one or more color channels and the pixel value of the protective ink channel.

10. A method for modifying an input digital image having one or more color channels corresponding to one or more color inks and a protective ink channel corresponding to a substantially clear protective ink, each channel having an (x,y) array of pixel values, to form a modified digital image comprising:

a) computing a row index value responsive to the corresponding pixel values of the one or more color channels;

b) computing a column index value responsive to the corresponding pixel value of the protective ink channel; and c) modifying the corresponding pixel value of the protective ink channel using a multidimensional look-up table indexed by the row index value and the column index value, wherein the multidimensional look-up table stores modified protective ink pixel values.

11. The method of claim 10 wherein the row index is computed by shifting and adding the pixel values of the one or more color channels.

* * * * *